US009443454B1

(12) United States Patent
Treece

(10) Patent No.: US 9,443,454 B1
(45) Date of Patent: Sep. 13, 2016

(54) REAL-ESTATE SIGN SUPPORT ASSEMBLY

(71) Applicant: Justin Michael Treece, Fort Lauderdale, FL (US)

(72) Inventor: Justin Michael Treece, Fort Lauderdale, FL (US)

(73) Assignee: GLOW POST, LLC, Fort Lauderdale, FL (US)

( * ) Notice: Subject to any disclaimer, the term of this patent is extended or adjusted under 35 U.S.C. 154(b) by 0 days.

(21) Appl. No.: 14/806,274

(22) Filed: Jul. 22, 2015

(51) Int. Cl.
*G09F 7/18* (2006.01)
*G09F 13/22* (2006.01)
*G09F 15/00* (2006.01)

(52) U.S. Cl.
CPC ..... *G09F 13/22* (2013.01); *G09F 7/18* (2013.01); *G09F 15/0006* (2013.01); *G09F 2007/1873* (2013.01); *G09F 2013/222* (2013.01)

(58) Field of Classification Search
CPC ..... G09F 7/18; G09F 7/22; G09F 15/0006; G09F 15/0037; G09F 2007/1856; G09F 2007/1873; G09F 15/00; E01F 9/0117; F21V 9/10; F21Y 2113/005; F21Y 2113/007
See application file for complete search history.

(56) References Cited

U.S. PATENT DOCUMENTS 2,260,082 A 10/1941 Mccauley et al.
5,101,329 A 3/1992 Doyle
5,467,076 A * 11/1995 Ruocco ..... G08B 7/06 315/76
5,564,816 A 10/1996 Arcadia et al.
6,017,131 A 1/2000 Goins
6,263,601 B1 7/2001 Emert
6,624,742 B1 9/2003 Romano et al.
6,624,842 B2 * 9/2003 McLaine ..... H04N 5/4401 348/42
6,976,329 B1 12/2005 Foster
7,158,020 B2 * 1/2007 Grady, Jr. ..... B60Q 7/00 116/63 T
7,549,245 B2 6/2009 Ter-Hovhannissian
7,585,085 B1 9/2009 Holman
8,414,169 B2 * 4/2013 Gloodt ..... B60Q 1/2688 362/497
8,459,826 B2 * 6/2013 Holman ..... F21S 8/086 362/183
8,585,085 B2 * 11/2013 Kobayashi ..... B60R 21/2644 102/530
8,631,998 B1 1/2014 Connelly et al.
8,668,137 B2 3/2014 Herzig
2002/0174090 A1 11/2002 Dexter
2004/0136189 A1 * 7/2004 Vanderschuit ..... F21S 10/06 362/235
2006/0050528 A1 3/2006 Lyons et al.
2006/0185203 A1 8/2006 Bittle et al.
2006/0194572 A1 8/2006 Fresonke et al.
2006/0227537 A1 * 10/2006 Vanderschuit ..... F21V 33/0028 362/154
2006/0260160 A1 11/2006 Herman
2006/0260161 A1 11/2006 Hamilton
2007/0017131 A1 1/2007 Visotcky et al.
2011/0185607 A1 8/2011 Forster et al.
2012/0221238 A1 * 8/2012 Shelby-Dyer ..... G09F 15/005 701/400

* cited by examiner

*Primary Examiner* — Cassandra Davis
(74) *Attorney, Agent, or Firm* — The Concept Law Group, P.A.; Scott D. Smiley; Yongae Jun

(57) ABSTRACT

A horizontal cross-arm assembly is disclosed having a housing with an external surface, the housing defining a horizontal cross-arm operably configured to support a real-estate sign thereunder. A plurality of color-changing light-sources are disposed within an interior cavity defined by the external surface of the housing, the plurality of color-changing light-sources operable to emit a colored light through the external surface of the housing. At least one controller is communicatively coupled to at least one of the plurality of color-changing light-sources, the controller operably configured to change a color of at least one of the plurality of color-changing light-sources from a first color to a second color, different from the first color.

20 Claims, 5 Drawing Sheets

400

400

300

REAL-ESTATE SIGN SUPPORT ASSEMBLY

FIELD OF THE INVENTION

The present invention relates generally to real-estate signs, and more particularly relates to a a light-emitting horizontal cross-arm assembly for supporting and illuminating a real-estate sign.

BACKGROUND OF THE INVENTION

It is well-known that real-estate signs positioned in front of residential or commercial real-estate properties are an important method of indicating to the public the availability of the real-estate property for sale, lease, or rent. Unfortunately, there exists a period during the evening where this marketing opportunity is not utilized because the real-estate sign is no longer clearly visible to passersby.

Lighted real-estate signs are known. Unfortunately, there are drawbacks to existing lighted real-estate sign solutions. Real-estate sign assemblies exist that illuminate the real-estate sign by traditional light bulbs. However, these light bulbs tend to blend in with similar bulb-based lights in a neighborhood and thereby may be easily missed by a passerby. For example, porch lights, yard lights, street lights, incandescent light bulbs emitting through a window from within a home may make the sign difficult to see from certain angles where surrounding lights obscure it.

In addition, real estate signs are typically not very attention-catching, particularly to passersby by who are focused on driving or may otherwise be occupied while traveling past the real-estate property. Even if the sign is lighted at night, the passersby may still not notice the real-estate sign and an opportunity to market the property is missed.

Existing solutions are cumbersome, complicated, and expensive. Relators desire an apparatus or method that allows them to market their numerous real-estate properties in an effective and efficient manner that does not require a large investment or a large deviation from a standard thin panel sign 100 attached to a horizontal cross-arm 102 that is affixed to a vertical post 104 (see FIG. 1). For example, some prior art lighted real-estate signs require the marketing indicia to be integrated into the lighted assembly, which requires relators to waste their existing real-estate signage and purchase the expensive lighted assembly with the marketing indicia integrated into the assembly. Accordingly, what is desired is an apparatus that allows relators to illuminate their existing real-estate signs, without a large deviation from the standard vertical post-horizontal cross-arm configuration, and using a unique type of illumination that attracts the attention of passersby during the night.

Therefore, a need exists to overcome the problems with the prior art as discussed above.

SUMMARY OF THE INVENTION

The invention provides a real-estate sign support assembly that overcomes the hereinafore-mentioned disadvantages of the heretofore-known devices and methods of this general type and that illuminates real-estate signs during the night in an attention-attracting manner.

With the foregoing and other objects in view, there is provided, in accordance with the invention, a horizontal cross-arm assembly for supporting a real-estate sign including a housing having an external surface, the housing defining a horizontal cross-arm operably configured to support a real-estate sign thereunder; a plurality of color-changing light-sources disposed within an interior cavity defined by the external surface of the housing, the plurality of color-changing light-sources operable to emit a colored light through the external surface of the housing; and at least one controller communicatively coupled to at least one of the plurality of color-changing light-sources, the at least one controller operably configured to change a color of at least one of the plurality of color-changing light-sources from a first color to a second color, different from the first color.

In accordance with another feature of the present invention, each of the plurality of color-changing light-sources includes an LED.

In accordance with yet another feature of the present invention, each of the plurality of color-changing light-sources includes a first LED operable to emit a red light, a second LED operable to emit a green light, and a third LED operable to emit a blue light. Each of the first LED, the second LED, and the third LED is communicatively coupled to a microcontroller operably configured to control colored light emissions of the first LED, the second LED, and the third LED to vary an output color produced by the color-changing light-source.

In accordance with a further feature of the present invention, the controller is operably configured to change colors of the plurality of color-changing light-sources according to a predetermined color changing pattern stored on a non-transitory memory of the at least one controller.

In accordance with yet a further feature of the present invention, the predetermined color changing pattern includes emitting colored lights from the plurality of color-changing light-sources such that at least one of the plurality of color-changing light-sources produces a color different than another color simultaneously produced by another one of the plurality of color-changing light-sources.

In accordance with another feature of the present invention, the external surface of the housing is of an acrylic material.

In accordance with yet another feature of the present invention, the external surface of the housing is of a frosted acrylic material.

In accordance with a further feature of the present invention, the housing is formed as an elongated rectangular shape.

In accordance with yet a further feature of the present invention, the housing is formed as an elongated rectangular shape.

In accordance with another feature of the present invention, the housing is formed as an elongated rectangular shape.

In accordance with another feature of the present invention, the housing substantially encloses the plurality of color-changing light-sources within the interior cavity.

In accordance with yet another feature of the present invention, each of the plurality of color-changing light-sources are arranged on a light-supporting substrate spaced-apart from one another in an array.

In accordance with yet another feature of the present invention, the plurality of color-changing light-sources are supported on a light-supporting strip.

In accordance with another feature, an embodiment of the present invention includes a light-supporting substrate supporting the plurality of color-changing light-sources; and a support member supporting the light-supporting substrate.

In accordance with another feature of the present invention, the external surface of the housing is of a light-diffusing material.

In accordance with a further feature, an embodiment of the present invention includes a battery electrically coupled to the plurality of color-changing light-sources and a light sensor, the light sensor operable to detect daylight and automatically turn off power to the plurality of color-changing light-sources as a result of detecting daylight.

In accordance with yet a further feature, an embodiment of the present invention further includes a near-field communication device is disposed on the external surface of the housing and is operable to transmit data wirelessly to an NFC-enabled electronic mobile device within an extremely close communication range to cause the NFC-enabled electronic mobile device to access a website corresponding to a real-estate location at which the real-estate sign is displayed.

In accordance with another feature, an embodiment of the present invention includes a real-estate sign support assembly having a horizontal cross-arm operably configured to support a real-estate sign, the horizontal cross-arm having an external surface defining a housing. The housing substantially encloses a plurality of color-changing light-sources operable to emit a colored light through the external surface of the housing. Each of the plurality of color-changing light-sources has a first LED operable to emit a red light; a second LED operable to emit a green light; a third LED operable to emit a blue light; and a microcontroller communicatively coupled to the first LED, the second LED, and the third LED, the microcontroller operably configured to change a color produced by the color-changing light-source by controlling the emissions of the red, green, and blue lights.

Although the invention is illustrated and described herein as embodied in a real-estate sign support assembly, it is, nevertheless, not intended to be limited to the details shown because various modifications and structural changes may be made therein without departing from the spirit of the invention and within the scope and range of equivalents of the claims. Additionally, well-known elements of exemplary embodiments of the invention will not be described in detail or will be omitted so as not to obscure the relevant details of the invention.

Other features that are considered as characteristic for the invention are set forth in the appended claims. As required, detailed embodiments of the present invention are disclosed herein; however, it is to be understood that the disclosed embodiments are merely exemplary of the invention, which can be embodied in various forms. Therefore, specific structural and functional details disclosed herein are not to be interpreted as limiting, but merely as a basis for the claims and as a representative basis for teaching one of ordinary skill in the art to variously employ the present invention in virtually any appropriately detailed structure. Further, the terms and phrases used herein are not intended to be limiting; but rather, to provide an understandable description of the invention. While the specification concludes with claims defining the features of the invention that are regarded as novel, it is believed that the invention will be better understood from a consideration of the following description in conjunction with the drawing figures, in which like reference numerals are carried forward. The figures of the drawings are not drawn to scale.

Before the present invention is disclosed and described, it is to be understood that the terminology used herein is for the purpose of describing particular embodiments only and is not intended to be limiting. The terms "a" or "an," as used herein, are defined as one or more than one. The term "plurality," as used herein, is defined as two or more than two. The term "another," as used herein, is defined as at least a second or more. The terms "including" and/or "having," as used herein, are defined as comprising (i.e., open language). The term "coupled," as used herein, is defined as connected, although not necessarily directly, and not necessarily mechanically. The term "providing" is defined herein in its broadest sense, e.g., bringing/coming into physical existence, making available, and/or supplying to someone or something, in whole or in multiple parts at once or over a period of time.

As used herein, the terms "about" or "approximately" apply to all numeric values, whether or not explicitly indicated. These terms generally refer to a range of numbers that one of skill in the art would consider equivalent to the recited values (i.e., having the same function or result). In many instances these terms may include numbers that are rounded to the nearest significant figure. In this document, the term "longitudinal" should be understood to mean in a direction corresponding to an elongated direction of the real-estate sign. The terms "program," "software application," and the like as used herein, are defined as a sequence of instructions designed for execution on a computer system. A "program," "computer program," or "software application" may include a subroutine, a function, a procedure, an object method, an object implementation, an executable application, an applet, a servlet, a source code, an object code, a shared library/dynamic load library and/or other sequence of instructions designed for execution on a computer system.

BRIEF DESCRIPTION OF THE DRAWINGS

The accompanying figures, where like reference numerals refer to identical or functionally similar elements throughout the separate views and which together with the detailed description below are incorporated in and form part of the specification, serve to further illustrate various embodiments and explain various principles and advantages all in accordance with the present invention.

DETAILED DESCRIPTION

Figure 1:
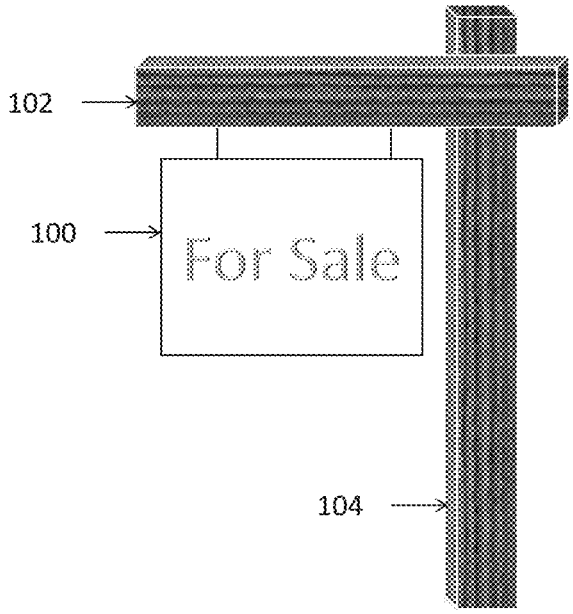
PRIOR ART FIG. 1
FIG. 1 is a front perspective view of a prior art real-estate sign assembly.

While the specification concludes with claims defining the features of the invention that are regarded as novel, it is believed that the invention will be better understood from a consideration of the following description in conjunction with the drawing figures, in which like reference numerals are carried forward. It is to be understood that the disclosed embodiments are merely exemplary of the invention, which can be embodied in various forms.

The present invention provides a novel and efficient real-estate sign illuminating horizontal cross-arm assembly.

Embodiments of the invention provide a housing for the horizontal cross-arm assembly that allows light emitting from within the housing to illuminate the real-estate sign supported by the horizontal cross-arm assembly. In addition, embodiments of the invention provide a plurality of color-changing light-emitting diodes (LED) on an LED strip within the housing, the plurality of color-changing LEDs operable to emit various colors through the housing so as to uniquely attract the attention of passersby such that they are more likely to notice the real-estate sign during the evening and be notified of the marketing content on the real-estate sign. Additional embodiments of the invention include a computer-readable feature, such as a barcode or near-field communication device, disposed on an external surface of the housing that allows cellular mobile devices to scan or communicate with the computer-readable feature in order to cause the cellular mobile device to access a real-estate website with information about the real-estate property where the real-estate sign is located.

Figure 2:
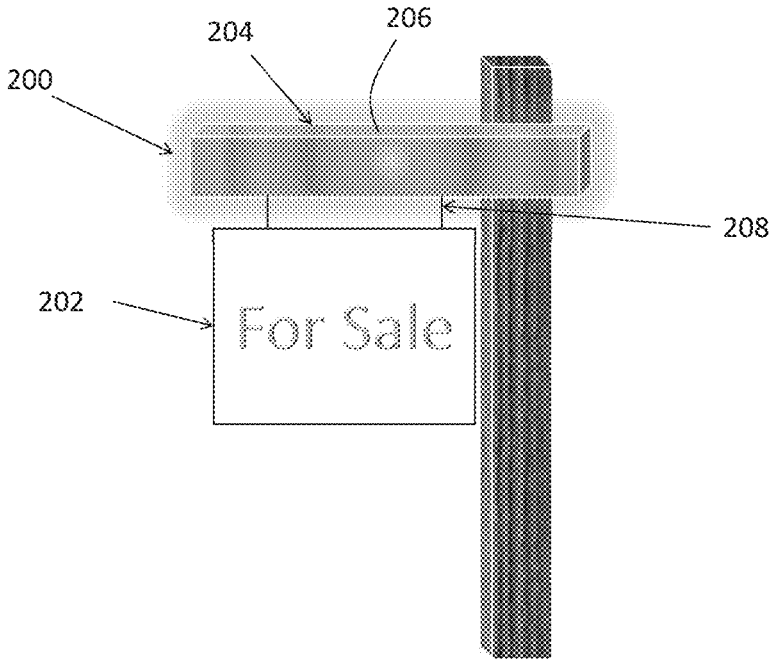
FIG. 2 is a front perspective view of a real-estate sign support assembly including an exemplary embodiment of a horizontal cross-arm supporting and illuminating a real-estate sign in accordance with the present invention.

Referring now to FIG. 2, one embodiment of the present invention is shown in a front perspective view. FIG. 2 shows several advantageous features of the present invention, but, as will be described below, the invention can be provided in several shapes, sizes, combinations of features and components, and varying numbers and functions of the components. The first example of a horizontal cross-arm assembly 200 for supporting a real-estate sign 202, as shown in FIG. 2, includes a housing 204 having an external surface 206.

The housing 204 defines a horizontal cross-arm and is operably configured to support the real-estate sign 202 beneath it. In one embodiment, a bottom portion of the housing 204 may be coupled to a pair of real-estate sign coupling members 208. The real-estate sign coupling members 208 may be, for example, hooks, screws, or other known fasteners used for coupling the housing 204 to the real-estate sign 202.

In one embodiment, the external surface 206 of the housing 204 is of an acrylic material. In another embodiment, at least a portion of the external surface of the housing 204 is of an acrylic material. In a further embodiment, a substantial portion of the external surface of the housing 204 is of an acrylic material. In yet a further embodiment, the entire external surface of the housing 204 is of an acrylic material. As is known in the art, acrylic is derived from an acrylic acid or related compound. Acrylic can also be referred to in the art as poly(methyl) methacrylate (PMMA) or "acrylic glass." Acrylic is sometimes clear/transparent and can be considered a glass-like plastic. In some embodiments, the acrylic material is lighter than glass, insulates better than glass, and is less breakable than glass. In yet another embodiment, the acrylic material is a light-transmitting material, operable to transmit a large percentage of light that passes through it. In a further embodiment, the acrylic material may transmit over 50% light. In yet a further embodiment, the acrylic material may transmit over 90% light. In other embodiment, the light-transmission percentage of the acrylic material may be outside of these ranges. In one embodiment, the acrylic material is formed as a relatively thin layer, or sheet, that is formed into an elongated rectangular shape for the housing 204. In another embodiment, the acrylic sheet can be formed as other shapes. In one embodiment, the acrylic material may be formed as a frosted acrylic material. The frosted surface may better hide fingerprints, scratches, and may conceal electronic components within the housing 204 from outside viewers. In one embodiment, the housing 204 may have a smooth external surface 206. In another embodiment, the housing 204 may have a textured external surface 206 so as to create a different visual effect.

In one embodiment, the acrylic material can be considered a light-diffusing material that provides a glow-like quality to light emitted from light-sources, such as light-emitting diodes (LEDs) or fluorescent lights. Rather than merely transmitting light therethrough, light-diffusing materials cause light from a light-source to diffuse, spread out, or scatter so as to create a soft light or glow effect. Advantageously, this glow effect can distinguish the lighting effect of the horizontal cross-arm assembly 200 of the present invention with other standard lights (e.g., standard incandescent light bulb) in a neighborhood and also create a visually attractive lighting effect that may further draw viewers' attention to the real-estate sign 202. In one embodiment, the acrylic material has a chemical compound containing phosphors, adhered to the interior of the cavity that gives off a phosphorescence effect when the lights are turned off.

The real-estate sign 202 may include various marketing and informational indicia printed thereon, such as, for example, "for sale," contact information for a realtor, a website link, a logo, or other marketing information. It is understood that the real-estate sign 202 may be any standard real-estate sign that is typically formed as a flat panel and may be plastic, sheet-metal, cardboard, or other paper-based material. Preferred embodiments of the present invention are directed toward an illuminating horizontal cross-arm that can be easily integrated into current real-estate signage assemblies and can provide illumination to existing real-estate signs 202 that are currently used by realtors.

Figure 3:
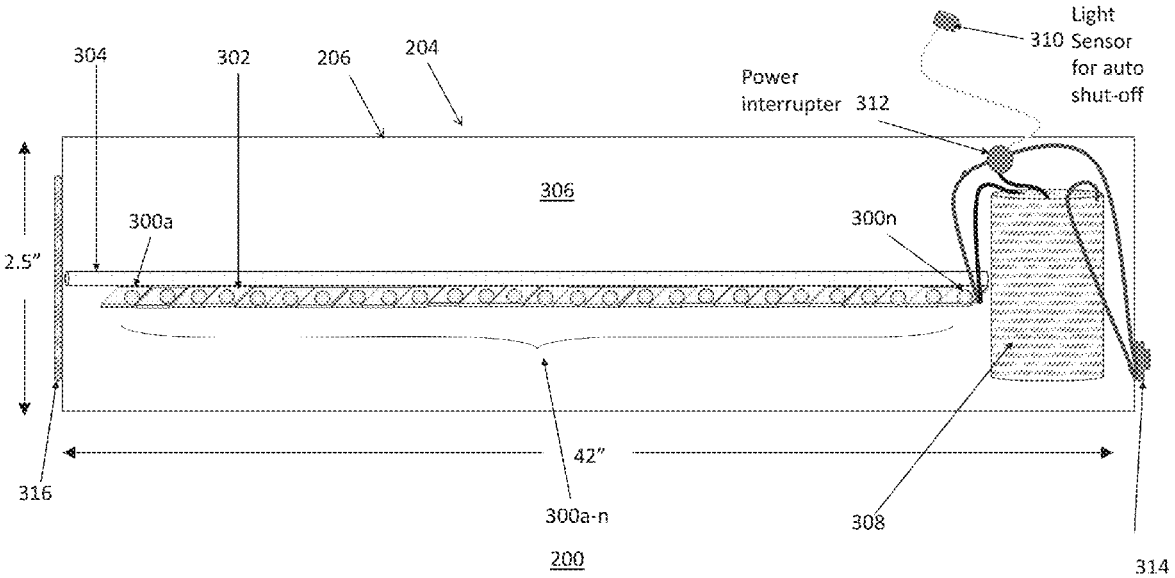
FIG. 3 is a cross-sectional view of the horizontal cross-arm of FIG. 3, illustrating an exemplary embodiment of internal components of the horizontal cross-arm, in accordance with the present invention.

Referring now to FIG. 3, an exemplary embodiment of internal hardware components of the horizontal cross-arm assembly 200 is illustrated in a cross-sectional view of the horizontal cross-arm assembly 200. In one embodiment, the horizontal cross-arm assembly 200 may include a plurality of color-changing light-sources 300*a-n*, a light-supporting substrate 302, and a support member 304. The number of color-changing light-sources 300*a-n* between "a" through "n" can be any number.

The plurality of color-changing light-sources 300 may be disposed within an interior cavity 306 defined by the external surface 206 of the housing 204. In one embodiment, the housing 204 may substantially enclose the plurality of color-changing light-sources 300 within the interior cavity 306. As used herein, the term "substantially enclose" is intended to indicate that the housing 204 provides an enclosure on all sides, which may or may not include one or more nominal openings, such as, for example, one or more openings for a fastener to be inserted therethrough in order to attach a real-estate sign to the housing 204. In the exemplary embodiment depicted in FIG. 3, the housing 204 is shown to be about 2.5 inches in height and about 42 inches in length. In other embodiments, the housing 204 may be formed with other dimensions. The plurality of color-changing light-sources 300 are operable to emit a light through the external surface 206 of the housing 204. In one embodiment, the plurality of color-changing light-sources 300 are operable to emit at least one colored-light through the external surface 206 of the housing 204. In another embodiment, the plurality of color-changing light-sources 300 are operable to emit more than one color of light through the external surface 206 of the housing 204.

In one embodiment, each of the plurality of color-changing light-sources 300 is formed as an LED. In another embodiment, each of the plurality of color-changing light-sources 300 may be formed as another type of light-source, such as, for example, an electron-stimulated light source, a light-emitting electrochemical cell (LEC) or other chemical-based lighting, etc. As used herein, the term "color-changing light-source" is intended to indicate a light-source operable to emit light that is perceived by the human eye to be a first color and that is able to be varied such that the same light-source is operable to, at a different time, emit light that is perceived by the human eye as at least one other color, different from the first color. The term "color-changing" is not intended to merely indicate a light-source that is able to turn on and off, but, rather, indicates a light-source that can change its light emissions from one color to another, different color.

In one embodiment, each of the plurality of color-changing light-sources 300 may be arranged on and supported by the light-supporting substrate 302. In a further embodiment, each of the plurality of color-changing light-sources 300 may be arranged as spaced-apart from one another in an array on the light-supporting substrate 302. In yet a further embodiment, each of the plurality of color-changing light-sources 300 may be arranged as equally spaced-apart from one another on the light-supporting substrate 302. In yet a further embodiment, each of the plurality of color-changing light-sources 300 may be provided on the light-supporting substrate 302 in other configurations and arrangements. In one embodiment, the light-supporting substrate 302 may include one or more layers of material on which the plurality of color-changing light-sources 300 is disposed upon. In another embodiment, the light-supporting substrate 302 physically contacts the plurality of color-changing light-sources 300. In yet another embodiment there may be provided an intermediate layer of material between the light-supporting substrate 302 and the plurality of color-changing light-sources 300. In one embodiment, the light-supporting substrate 302 may be formed as a strip of material. As used herein, the term "strip" is defined as a narrow piece of material that is relatively elongated in length and substantially uniform in width. In another embodiment, the light-supporting substrate 302 may be formed in other shapes, sizes, and configurations.

In one embodiment, the plurality of color-changing light-sources 300 and the light-supporting substrate 302 may be supported by the support member 304. In one embodiment, the support member 304 may be of a rigid or semi-rigid material, such as a rigid plastic material. In another embodiment, the support member 304 may be formed as an elongated, horizontally disposed, linear support bar. In yet another embodiment, the support member 304 may be formed as a planar support shelf. In a further embodiment, the support member 304 may extend horizontally from one end of the housing 204 to an opposing end of the housing 204. In yet a further embodiment, the support member 304 may extend from one end of the housing 204 to another component within the housing, such as a battery. In other embodiments, the support member 304 may be formed as other shapes, sizes, and configurations. In one embodiment, the support member 304 may be formed integrally with the housing 204. In another embodiment, the support member 304 may be selectively couplable to the housing 204 so as to be removable and replaceable. In yet another embodiment, the light-supporting substrate 302 and the plurality of color-changing light-sources 300 are together selectively couplable to the support member 304 and/or the housing 204 so as to be removable and replaceable, such as, for example, as a result of the realtor desiring to replace the plurality of color-changing light-sources 300 with another light source.

In one embodiment, the horizontal cross-arm assembly 200 may further include a battery 308 and a light sensor 310. In one embodiment, the battery 308 may be a rechargeable battery. In another embodiment, the battery 308 may be a non-rechargeable battery. The battery 308 may be formed as an alkaline battery, a lithium battery, a lead or nickel-based battery, or any type of known battery. In a preferred embodiment, the battery 308 possesses a relatively long life so that it does not require the user to change or recharge it often. The battery 308 may be electrically coupled to the plurality of color-changing light-sources 300 and the light sensor 310.

In one embodiment, the light sensor 310 is operable to detect daylight and automatically turn off power to the plurality of color-changing light-sources 300 as a result of detecting daylight, so as to conserve power. In another embodiment, the light sensor 310 may be configured to detect when levels of sunlight are below a predetermined threshold and, as a result of detecting that the levels of sunlight are below the predetermined threshold, activate the plurality of color-changing light-sources 300. In yet a further embodiment, the predetermined threshold may be configured so that the light sensor 310 detects dusk. In yet a further embodiment, the light sensor 310 may be configured to detect dusk and, as a result of detecting dusk, turn on power to the plurality of color-changing light-sources 300 and, additionally, detect dawn, and, as a result of detecting dawn, turn off power to the plurality of color-changing light-sources 300. In one embodiment, a processor, microprocessor, or other controller may be electrically coupled to the light sensor 310, the battery 308, and the plurality of color-changing light-sources 300 and be configured to control this power saving functionality. In one embodiment, the horizontal cross-arm assembly 200 may further include a power interrupter 312 electrically coupled to the light sensor 310 and the battery 308 and configured to interrupt power flowing from the battery 308 to the plurality of color-changing light-sources 300 as a result of the light sensor 310 detecting daylight, dawn, or some other indication that the evening is over and the morning has arrived. In another embodiment, the horizontal cross-arm assembly 200 may include an on-off actuator 314 operable for a user to selectively turn on, or activate the horizontal cross-arm assembly 200. In yet another embodiment, the on-off actuator 314 may be formed as, for example, a button, a switch, a lever, or another known type of actuator. The on-off actuator 314 may be formed integrally with the housing 204 (i.e., unitary) or may be removably coupled to the housing 204. Preferably, at least a portion of the on-off actuator 314 is disposed external to the housing 204 so as to be accessible by the user to turn the horizontal cross-arm assembly 200 on or off from the outside.

In one embodiment, the horizontal cross-arm assembly 200 may include a near field communication (NFC) device 316. The NFC device 316 may be formed as an NFC chip, active or passive NFC tag, or other NFC circuitry that includes an antenna configured for extremely short range radio communications at relatively low data rates (e.g., 424 kb/s). The NFC device 316 may use magnetic field induction to communicate with other NFC-enabled devices, such as an NFC-enabled electronic mobile device to retrieve and/or send information. The NFC device 316 may enable initiation and/or facilitation of real-estate related data to be transferred from the NFC device 316 to, for example, a smartphone of a potential purchaser within an extremely close range (e.g., 4 centimeters). The extremely close communication range of the NFC device 316 may be on the order of centimeters.

Figure 4:
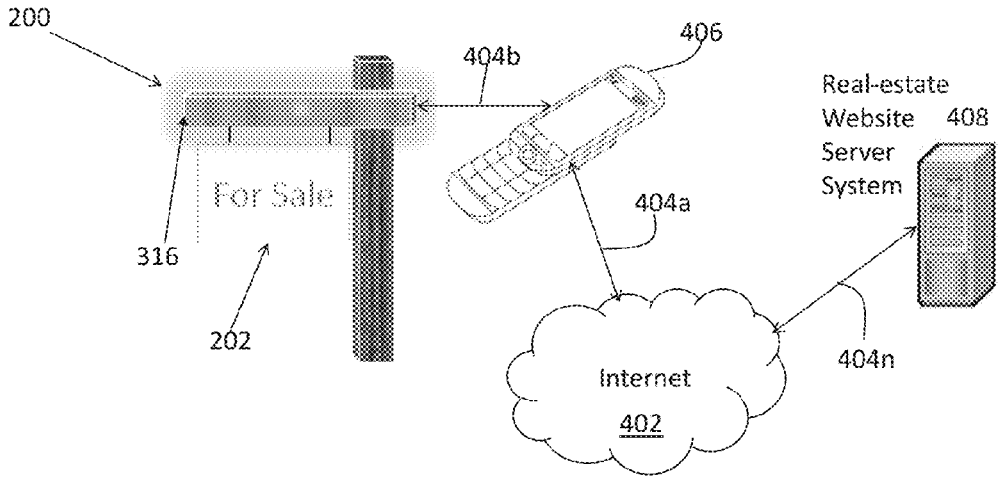
FIG. 4 is a block diagram illustrating an exemplary network, in accordance with an embodiment of the present invention.

Referring now to FIG. 4 with reference to FIG. 3, an exemplary embodiment showing an implementation of the NFC feature of the present invention is described. FIG. 4 depicts an exemplary network diagram of a network 400 that may be implemented in accordance with the present invention for directing the potential purchaser's mobile electronic device to a corresponding real-estate related website.

In the depicted example, the network 400 can include the Internet 402, which represents a worldwide collection of networks and gateways that use the TCP/IP suite of protocols to communicate with one another. At the heart of the Internet 402 is a backbone of high-speed data communication lines between major nodes or host computers, consisting of thousands of commercial, government, educational and other computer systems that route data and messages. Of course, network 400 also may be implemented as a number of different types of networks, such as for example, an Intranet, a local area network (LAN), or another wide area network (WAN). FIG. 4 is intended as an example, and not as an architectural limitation for the present invention.

The network 400 includes connections 404*a-n*, which are the medium used to provide communication links between various devices and computers, or computing devices, connected together within the network 400. The connections 404*a-n* may be wired or wireless connections. A few exemplary wired connections are cable, phone line, and fiber optic. Exemplary wireless connections include radio frequency (RF) and infrared radiation (IR) transmission. Many other wired and wireless connections are known in the art and can be used with the present invention.

The network 400 may include additional servers and other devices and entities not shown. Communication between the devices coupled to each other on the network 400 may occur through the Internet 402, or another wireless or wired data exchange method, e.g., Bluetooth, radio frequency identification (RFID), and the like. Moreover, any of the depicted network entities, in addition to communicating with each other over the network 400, are, in some embodiments, also able to communicate in a peer-to-peer relationship using wired or wireless links. In embodiments of the present invention, various computing entities located on the network 400 may perform all, or some, of the herein-described steps of the present invention.

In one embodiment, the NFC device 316 may be formed as a passive NFC tag that is activated when an NFC-enabled smartphone 406 physically taps the NFC tag, thereby inducing a small electrical current within the NFC tag. The NFC device 316 may then wirelessly transmit, to the NFC-enabled smartphone 406, an I.P. address or other indication of a real-estate website corresponding to a real-estate location at which the horizontal cross-arm assembly 200 and associated real-estate sign 202 are physically located. In response, the potential purchaser's NFC-enabled smartphone 406 may automatically access the real-estate website over the Internet 402 by communicating with a real-estate website server system 408. The real-estate website server system 408 may be formed as a single server, or may be implemented as a plurality of servers via, for example, a cloud network. The NFC-enabled smartphone 406 may then open a browser or other software application that is configured to display information from the real-estate website server system 408 about the real-estate property.

In a preferred embodiment, the NFC device 316 is disposed on the external surface 206 of the housing 204 so as to be viewable and easily tapped by the potential purchaser's smartphone. As used herein, the term "tap" is intended to indicate a physical contact or touch between the NFC device 316 and the potential purchaser's NFC-enabled mobile electronic device 406. In a further embodiment, the NFC device 316 is removably couplable to the external surface 206 of the housing 204. For example, the NFC device 316 may be couplable to the housing 204 by a clip, a clamp, a hook-and-loop attachment system, an adhesive, a pocket, or another type of fastening mechanism. Advantageously, this allows realtors to re-use the horizontal cross-arm assembly 200 for a multitude of real-estate properties by switching out the NFC device 316 for each different property so that the correct website information can be transferred to the potential purchaser's smartphone, that is, the website information corresponding to the real-estate property that the horizontal cross-arm assembly 200 is currently located at. In another embodiment, the NFC device 316 may be configured to communicate an I.P. address of the website's home page and the potential purchaser may be required to input an address or other identifying information within the home page of the website in order to be directed to the correct web page associated with the particular property. Although the potential purchaser's NFC-enable device is depicted in the exemplary embodiment as the NFC-enabled smartphone 406, it is understood that it may also be implemented as other NFC-enabled devices known in the art, such as a computer tablet or other mobile electronic device with a processor, a memory, and/or a wireless transmitter. In addition, although the exemplary embodiment is shown implemented as an NFC network, it is understood that in some embodiments, the potential purchaser's mobile electronic device may be automatically directed to the real-estate related website by other short range wireless or wired communication protocols, such as a barcode or RFID device.

Figure 5:
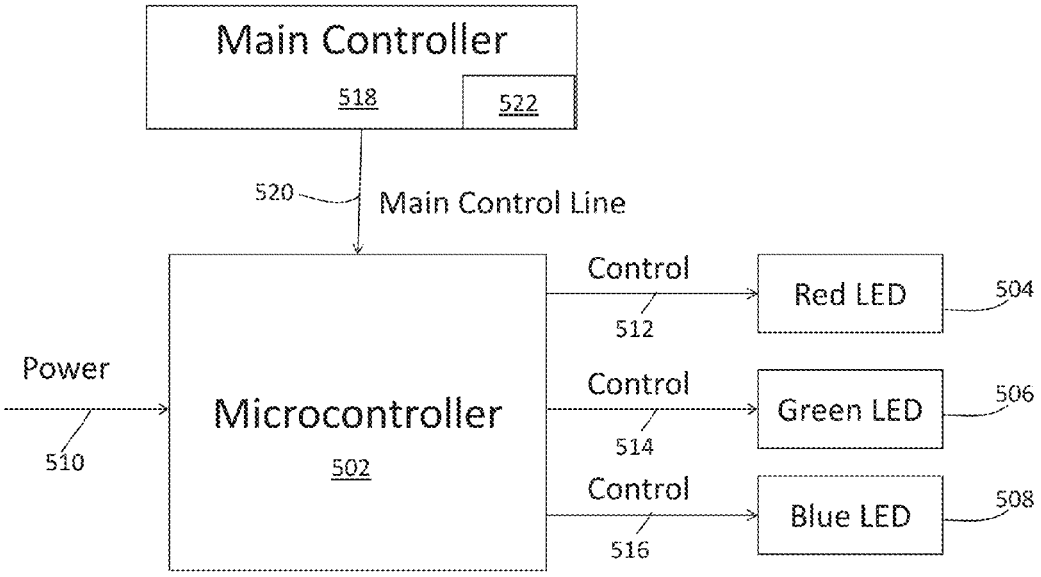
FIG. 5 is a block diagram illustrating electronic hardware components of an exemplary color-changing light-source, in accordance with the present invention.

Referring now to FIG. 5 with brief reference to FIG. 3, an exemplary embodiment of one of the plurality of color-changing light-sources 300 is illustrated in a block diagram view. In one embodiment, the color-changing light-source 300 includes a microcontroller 502, a first LED 504, a second LED 506, and a third LED 508.

Although the exemplary embodiment described with reference to FIG. 5 includes a microcontroller, it is understood that the present invention may be implemented using another data processing device, such as, for example, a controller, a processor, a central processing unit (CPU), a "general purpose" microprocessing device, a special purpose microprocessing device, or the like. The microcontroller 502 executes code stored in transitory or non-transitory member in order to carry out operation/instructions of the horizontal cross-arm assembly 200.

In one embodiment, the microcontroller 502 is communicatively coupled to at least one of the plurality of color-changing light-sources 300 and is operably configured to change a color of at least one of the color-changing light-sources 300 from a first color to a second color, the second color being different from the first color. For example, the microcontroller 502 may be operably configured to change the color-changing light-source 300 from emitting light rays that are the color purple to begin emitting light rays that are the color yellow. In another embodiment, the microcontroller 502 may be operably configured to change the color-changing light-source 300 to emit three different colors, such as from purple, to yellow, to green. In other embodiments, the microcontroller 502 may be operably configured to change the color-changing light-source 300 to more than three different colors or less than three different colors. In one embodiment, the microcontroller 502 may be operably configured to allow the color-changing light-source 300 to emit only a single color. In a further embodiment, the single color may be a preprogrammed default color. In yet a further embodiment, the microcontroller 502 may be configured so as to allow the realtor or the user to select the single color. In yet a further embodiment, the microcontroller 502 may be configured so as to allow the realtor to select a user-defined color pattern, which may include emission of a single user-selected color and the emission of a plurality of user-selected colors according to a user-defined color changing pattern. For example, the realtor may initially select a single color, e.g. a dark blue, and later (in order to attract even more attention) select a different emission pattern, e.g., dark blue to light blue to yellow and back around to dark blue again. Accordingly, realtors may be able to vary the color-changing pattern as desired. In one embodiment, realtors can vary the color changing pattern corresponding to an occasion or event, such as red, white, and blue, for July $4^{th}$, select sports team colors during a major sporting event, or colors associated with a real estate brokerage's color scheme In one embodiment, the horizontal cross-arm assembly 200 may include a single microcontroller or other data processing device to control the plurality of color-changing light-sources 300. In another embodiment, the horizontal cross-arm assembly 200 may include one microcontroller 502 for each of the color-changing light-sources 300. The microcontroller 502 can be considered a driver controlling the LEDs 504, 506, 508. In other words, in an embodiment where there are ten color-changing light-sources 300, there may also be provided at least ten microcontrollers 502, each of the ten microcontrollers 502 controlling the emission of the LEDs 504, 506, and 508 included in the corresponding color-changing light-source 300.

In one embodiment, the first LED 504 is operable to emit a red light and can be considered a red LED 504. In another embodiment, the second LED 506 is operable to emit a green light and can be considered a green LED 506. In yet another embodiment, the third LED 508 is operable to emit a blue light and can be considered a blue LED 508. The red LED 504, the green LED 506, and the blue LED 508 may be communicatively and electrically coupled to the microcontroller 502, which is operably configured to control colored light emissions of the LEDs 504, 506, and 508 to vary an overall output color produced by the color-changing light-source 300. As is generally known, various combinations of red, green, and/or blue may produce various colors.

In one embodiment, the microcontroller 502 may include an input port for a power line 510 and three output ports each corresponding to a control line 512, 514, and 516 for sending control signals to each of the LEDs 504, 506, 508. In another embodiment, the microcontroller 502 may include two power lines 510, where one power line provides power to the microcontroller 502 and the second power line provides power to the LEDs 504, 506, 508. The control lines 512, 514, and 516 may be used by the microcontroller 502 to turn on or off each of the red LED 504, the green LED 506, and the blue LED 508, respectively. For example, the microcontroller 502 may use the control line 512 to turn the red LED 504 on and the control line 516 to turn the blue LED 508 on simultaneously, such that the visual output of the color-changing light-source 300 is a shade of purple, also called "magenta." As another example, the microcontroller 502 may use the control line 512 to turn the red LED 504 on and the control line 514 to turn the green LED 506 on simultaneously, such that the visual output of the color-changing light-source 300 is a shade of yellow. As yet another example, the microcontroller 502 may use the control line 514 to turn the green LED 506 on and the control line 516 to turn the blue LED 508 on simultaneously, such that the visual output of the color-changing light-source 300 is a shade of cyan.

In one embodiment, the microcontroller 502 may also control an intensity or level of brightness of the LEDs 504, 506, and 508 so as to provide even more color variety to the color-changing light-source 300. For example, if the red LED 504 is turned on at only 50% of its normal brightness than a color midway between red and magenta may be generated by the red LED 504. If, at the same time, the blue LED 508 is gradually increased from 0% brightness to 100% brightness, then the output color of the color-changing light-source 300 will gradually vary from the color red to the color magenta, creating an attractive color-changing lighting effect. Accordingly, the microcontroller 502 can be programmed to create a multitude of attractive color-changing patterns using a broad spectrum of different color varieties and patterns by turning the LEDs 504, 506, 508 on and off and varying the brightness of the LEDs 504, 506, and 508.

In one embodiment, the horizontal cross-arm assembly 200 may include a main controller 518 that may be responsible for controlling each of the plurality of color-changing light-sources 300 via a main control line 520. The main controller 518 may be operably configured to change colors of the plurality of color-changing light-sources 300 according to a predetermined color changing pattern that may be stored on a non-transitory memory 522 of the main controller 518. For example, the memory 522 may store a predetermined pattern indicating that the plurality of color-changing light-sources 300 vary from a visual output of blue to green light every 3 seconds. In another embodiment, the predetermined color changing pattern may indicate that at least one of the plurality of color-changing light-sources 300 produces a different output color than the other color-changing light-sources 300 simultaneously. For example, the predetermined color changing pattern may indicate that half of the color-changing light-sources 300 in the horizontal cross-arm assembly 200 emit a magenta colored light, while the other half of the color-changing light-sources 300 emits a blue colored light, and that the colors switch every 10 seconds. Accordingly, the present invention advantageously allows for a wide variety of color-changing patterns so that the visual lighting effect of the horizontal cross-arm assembly 200 can be tailored to the user and produce a multitude of attractive lighting effects that may be used as a realtor marketing tool during the evening hours, where many prior art real-estate signs are deficient. Although the description above describes LED light-sources, it is understood that any color-changing light-source may be used with the present invention, unless otherwise indicated.

A novel and efficient horizontal cross-arm assembly has been disclosed that allows light emitting from within a horizontal cross-arm housing to illuminate a real-estate sign supported by the horizontal cross-arm assembly. In addition, embodiments of the invention provide a plurality of color-changing light-sources on a light-supporting substrate within the housing, the plurality of color-changing light-sources operable to emit various colors through the housing so as to uniquely attract the attention of passersby such that they are able to notice the real-estate sign during the evening and be notified of the marketing content on the real-estate sign.

What is claimed is:

1. A real-estate sign assembly comprising:

a real-estate sign;

a transparent horizontal cross-arm including:

a transparent housing having a transparent external surface, the transparent housing defining a transparent horizontal cross-arm body operably configured to support the real-estate sign thereunder;

a plurality of color-changing light-sources disposed within an interior cavity defined by the transparent external surface of the housing, the plurality of color-changing light-sources operable to emit a colored light through the transparent external surface of the transparent housing; and at least one controller communicatively coupled to at least one of the plurality of color-changing light-sources, the at least one controller operably configured to change a color of at least one of the plurality of color-changing light-sources from a first color to a second color, different from the first color; and a vertical post with an upper portion, the transparent horizontal cross-arm coupled to and supporting the real-estate sign thereunder and transversely attached to the upper portion of the vertical post so as to form the real-estate sign assembly.

2. The real-estate sign assembly in accordance with claim 1, wherein:

each of the plurality of color-changing light-sources includes an LED.

3. The real-estate sign assembly in accordance with claim 1, wherein:

each of the plurality of color-changing light-sources includes a first LED operable to emit a red light, a second LED operable to emit a green light, and a third LED operable to emit a blue light, each of the first LED, the second LED, and the third LED communicatively coupled to a microcontroller operably configured to control colored light emissions of the first LED, the second LED, and the third LED to vary an output color produced by the color-changing light-source.

4. The real-estate sign assembly in accordance with claim 1, wherein:

the at least one controller is operably configured to change colors of the plurality of color-changing light-sources according to a predetermined color changing pattern stored on a non-transitory memory of the at least one controller.

5. The real-estate sign assembly in accordance with claim 4, wherein:

the predetermined color changing pattern includes emitting colored lights from the plurality of color-changing light-sources such that at least one of the plurality of color-changing light-sources produces a color different than another color simultaneously produced by another one of the plurality of color-changing light-sources.

6. The real-estate sign assembly in accordance with claim 1, wherein:

the transparent external surface of the transparent housing is of an acrylic material.

7. The real-estate sign assembly in accordance with claim 1, wherein:

the vertical post is oriented substantially perpendicular to the transparent horizontal cross-arm.

8. The real-estate sign assembly in accordance with claim 1, wherein:

the transparent housing is formed as an elongated rectangular shape.

9. The real-estate sign assembly in accordance with claim 1, wherein:

the transparent housing substantially encloses the plurality of color-changing light-sources within the interior cavity.

10. The real-estate sign assembly in accordance with claim 1, wherein:

each of the plurality of color-changing light-sources are arranged on a light-supporting substrate spaced-apart from one another in an array.

11. The real-estate sign assembly in accordance with claim 1, wherein:

the plurality of color-changing light-sources are supported on a light-supporting strip.

12. The real-estate sign assembly in accordance with claim 1, further comprising:

a light-supporting substrate supporting the plurality of color-changing light-sources; and a support member supporting the light-supporting substrate.

13. The real-estate sign assembly in accordance with claim 1, wherein:

the transparent external surface of the transparent housing is of a light-diffusing material.

14. The real-estate sign assembly in accordance with claim 1, further comprising:

a battery electrically coupled to the plurality of color-changing light-sources and a light sensor, the light sensor operable to detect daylight and automatically turn off power to the plurality of color-changing light-sources as a result of detecting daylight.

15. The real-estate sign assembly in accordance with claim 1, further comprising:

a near-field communication device disposed on the transparent external surface of the transparent housing and operable to transmit data wirelessly to an NFC-enabled electronic mobile device within an extremely close communication range to cause the NFC-enabled electronic mobile device to access a website corresponding to a real-estate location at which the real-estate sign is displayed.

16. A real-estate sign support assembly comprising:

a real-estate sign;

a transparent horizontal cross-arm operably configured to support the real-estate sign, the transparent horizontal cross-arm having an external surface that is entirely transparent, the external surface defining a transparent housing body, the transparent housing body substantially enclosing:

a plurality of light-sources operable to emit a light through the external surface of the transparent housing body; and a vertical post with an upper portion, the transparent horizontal cross-arm coupled to and supporting the real-estate sign thereunder and transversely attached to the upper portion of the vertical post so as to form the real-estate sign assembly.

17. The real-estate sign support assembly in accordance with claim 16, wherein:

the vertical post is oriented substantially perpendicular to the transparent horizontal cross-arm.

18. The real-estate sign support assembly in accordance with claim 16, further comprising:

a battery electrically coupled to the plurality of color-changing light-sources; and a light sensor, the light sensor operable to detect daylight and automatically turn off power to the plurality of color-changing light-sources as a result of detecting daylight.

19. The real-estate sign support assembly in accordance with claim 16, further comprising:

a near-field communication device disposed on the external surface and operable to transmit data wirelessly to an NFC-enabled electronic mobile device within an extremely close communication range to cause the NFC-enabled electronic mobile device to access a website corresponding to a real-estate location at which the real-estate sign is displayed.

20. The real-estate sign support assembly in accordance with claim 16, wherein:

each of the plurality of light-sources is a color-changing light-source having:

a first LED operable to emit a red light;

a second LED operable to emit a green light;

a third LED operable to emit a blue light; and a microcontroller communicatively coupled to the first LED, the second LED, and the third LED, the microcontroller operably configured to change a color produced by the color-changing light-source by controlling the emissions of the red, green, and blue lights.

* * * * *